United States Patent [19]

Chachin et al.

[11] 4,344,313

[45] Aug. 17, 1982

[54] HYDROPUNCH FOR USE IN A PRESS

[76] Inventors: Viktor N. Chachin, ulitsa Kulmana, 15, kv. 91; Vladimir K. Kolos, ulitsa Kulmana, 26, kv. 50; Viktor V. Botyan, ulitsa Lenina, 11/35, kv. 11; Vladimir I. Luzgin, ulitsa Plekhanova, 63, kv. 52; Igor K. Antonenkov, Izmailovsky pereulok, 47, kv. 2, all of Minsk, U.S.S.R.

[21] Appl. No.: 109,296

[22] Filed: Jan. 3, 1980

[51] Int. Cl.[3] ..... B21J 7/38

[52] U.S. Cl. ..... 72/453.1; 72/63; 72/453.02

[58] Field of Search ..... 72/453.1, 453.01, 453.11, 72/453.02, 453.18, 60, 63

[56] References Cited

U.S. PATENT DOCUMENTS

| | | | |
|---|---|---|---|
| 1,562,426 | 11/1925 | Erickson | 269/59 |
| 3,205,790 | 9/1965 | Bollar | 72/453.1 |
| 3,352,143 | 11/1967 | Bollar | 72/453.11 |
| 3,376,723 | 4/1968 | Chelminski | 72/453.1 |
| 3,584,498 | 6/1971 | Beche | 72/453.18 |

FOREIGN PATENT DOCUMENTS

| | | | |
|---|---|---|---|
| 1562426 | 4/1969 | France . | |
| 2138378 | 1/1973 | France . | |
| 524595 | 10/1976 | U.S.S.R. | 72/453.1 |

*Primary Examiner*—Gene Crosby

*Attorney, Agent, or Firm*—Fleit & Jacobson

[57] ABSTRACT

A hydropunch comprises a cylinder, with one end thereof facing the working surface of a die intended for positioning thereon a workpiece to be treated. Accommodated inside the cylinder and forming an above-the-ram chamber and a below-the-ram chamber is a ram which is actuated by means of a suitable actuator mounted on that end of the cylinder which is opposite to the aforementioned end thereof, the ram being connected with a system for returning the ram to its original position. In addition, the hydropunch includes a compressed gas receiver communicating with the above-the-ram chamber of the cylinder, and a cover adapted for closing both the cylinder and receiver. In accordance with the invention, the system for returning the ram to its original position comprises a closed chamber communicating with the below-the-ram chamber of the cylinder, and a value intended for communicating the above-the-ram chamber with the atmosphere.

3 Claims, 3 Drawing Figures

HYDROPUNCH FOR USE IN A PRESS

BACKGROUND OF THE INVENTION

1. Field of the Invention

The present invention relates to mechanical working of metals and more in particular to hydraulic presses.

This invention can advantageously be used for the manufacture of fast-acting hydraulic presses effective for punching sheet materials through elastic, hydroelastic (through fluid via elastic diaphragm), and fluid media. In addition, this invention can find application in the manufacture of pneumatic percussion press installations.

2. Description of the Prior Art

There is known in the art a hydropunch which comprises a cylinder with a ram movably mounted therein. The ram is forced down by compressed gas to strike against an elastic medium contained in the working chamber, thus creating high pressure therein effecting the deformation of the workpiece. In order to avoid an excessive increase of pressure inside the cylinder in the interspace between the ram and the elastic medium (fluid), and to prevent kinetic energy of the ram from being absorbed by air cushion, the part of the cylinder chamber disposed before the elastic medium is communicated with the atmosphere through outlet ducts.

However, it is rather problematic to return the ram to its original position on completion of its operating stroke.

There is known, for example, a hydropunch wherein the ram is raised to its original position by means of working fluid passing from a hydraulic drive under the ram. Once the ram is up, the fluid is to be removed from the cylinder, for example, by means of blowing air therethrough. Therefore, the hydraulic system as a whole is rendered cumbersome by an excessive number of various controlling, regulating and distributing devices, as well as pumps, pipelines and other auxiliary components provided therein. The time period required for ram-raising-, air-blowing, and fluid-draining operations is 50 to 60 sec., French Pat. No. 1,562,426.

In other known hydropunches (cf. The article "High-Speed Working by Hydropunch Method", Ratjen R., Takamatsu M., Express Information Bulletin No. 21, 1971, series "Forging and Pressing Production Technology and Equipment)", with the ram impact on the fluid, the above-the-ram chamber of the cylinder is successively brought into communication, through respective valves, with a compressed gas receiver, with the atmosphere and, finally, with the vacuum receiver. Therefore, the operations undertaken to return the ram to its original position are disadvantageous in that they increase the time period of the operating cycle. Furthermore, the provision of valves, pipelines and receivers makes the hydropunch more complicated and expensive in construction.

There is also known an apparatus for establishing hydraulic impact load (cf. French Pat. No. 2,138,378), which comprises a cylinder with a stepped ram, a chamber intended for a water diaphragm to be formed therein which chamber is positioned before the cylinder and is separated therefrom by a partition with an opening in its centre to receive the ram. The partition is also provided with a plurality of holes facing recesses formed in the ram, through which air is passed to effect return stroke of the ram; a headpiece for supplying water required to form the diaphragm; a water outlet and an air vent hole; an air supply regulating valve; an additional air distributor; a gate; a return stroke distributor; a valve for stopping the ram on its return stroke; a duct-and-pipeline system.

In the aforedescribed apparatus a means for returning the ram to its original position comprises a return-stroke control valve, a duct intended to communicate the directional control valve with the cylinder, a duct with a valve, intended for the passage of air fed through the control valve under the ram, and a duct communicating the above-the-ram chamber of the cylinder, through control valve with the atmosphere. The ram is returned to its original position in the following manner.

When the downwardly moving ram reaches the water diaphragm, the ram accelerating air passes through a duct and thus causes displacement of the return-stroke control valve plunger, thereby communicating the above-the-ram chamber of the cylinder with the atmosphere. As a result, the air pressure is brought down in the cylinder. At the same time, the air from the receiver is admitted beneath the ram, thereby initiating its return stroke. As pressure drops in the cylinder, the spring-actuated plunger of the control valve is returned to its original position, thereby discommunicating the above-the-ram chamber of the cylinder and stopping the supply of air under the ram. On having gained speed, the ram continues its movement by inertia, and at the end of its return stroke it is cushioned by the air present in the above-the-ram chamber of the cylinder.

However, the apparatus described above is not free from disadvantages, the most serious of which is complexity of its construction which, in turn, may bring about failures in operation. All compressed gas control valves of the type described above are known to suffer from gas leakage due to occur through gaps in the housing-and-valve assembly. In order to preclude leakage in air control valves, the size of gaps in the housing-and-valve assembly should be minimized (a gapless assembly would be ideal), and the presence of moisture in the air makes it imperative to manufacture them from corrosion-resistant materials. In addition, these types of control valves require that the air be thoroughly cleaned of solid impurities and a lubricant oil be well pulverised to provide for effective lubrication of the surfaces subject to friction.

Other disadvantages of the prior-art apparatus lie in that it requires a high flow rate of air to be admitted beneath the ram so as to initiate its return stroke. As the ram is returned to its original position, it strikes against the traction rod of the auxiliary control valve, thereby shortening the service life of the latter.

Still another disadvantage of the prior-art apparatus is the absence of means required for retaining the ram in its original position, which may result in failure to actuate the ram. From the above it follows that the aforedescribed apparatus (inclusive of the means for returning the ram) is operable if furnished with a stepped ram. In other words, the ram mass per unit of the cylinder area (specific mass), wherein impact load is created, will be substantial. However, the ram with a minimum specific mass is known to be more effective for such operations as shaping rigid reliefs, coining and sizing. This being the case, the process in the chamber is similar to a shock-wave process, which is characterized by an extremely high pressure on the wave front, whereas in the event of a big specific mass of the ram, the process in the chamber is more of a static nature (quasistatic). For the aforesaid operations efficiency of the energy transfer from the fluid, with a high impulsive pressure established therein, to the work-piece is considerably higher when the transfer of energy is effected in the form of a shock wave than through the intermediary of quasi-static pressure.

The principal object of the invention is to provide a hydropunch for use in a press which will be more simple in construction and reliable in operation than similar arrangements known in the art.

Another object of the invention is to provide a hydropunch which will have higher efficiency than the prior-art arrangements of similar type.

Still another object of the invention is to provide a hydropunch of the type to permit a faster return of the ram to its original position and reliable fixing thereof in this position.

Yet another important object of the invention is to provide a hydropunch of the type permitting both the travelling path and leakage of air to be reduced during working and return strokes of the ram.

Another object of the invention is to provide a hydropunch which will ensure a reliable return of the ram to its original position in the event of using a fluid as the working medium while subjecting workpieces to large amounts of deformation.

These and other objects of the invention are attained in a hydropunch for use in a press including a die on the working surface of which is placed a piece to be worked, comprising a cylinder having a wall body with two ends, one of which faces the working surface of the die, the other looking in the opposite direction therefrom; a ram accommodated within said cylinder with a possibility to move therealong so as to form therein an above-the-ram chamber and a below-the-ram chamber; a means for actuating said ram, said means being arranged on the opposite end of said cylinder; a compressed gas receiver communicating with the above-the-ram chamber; a cover intended for closing both said cylinder and receiver; a means for returning the ram to its original position, said means including a closed chamber communicating with the below-the-ram chamber of said cylinder, and a valve adapted to communicate the above-the-ram chamber of said cylinder with the atmosphere.

Such construction of the means for returning the ram to its original position makes it possible to eliminate the valve-and-pipeline system, thereby ensuring, on the one hand, a simple and reliable construction and, on the other, precluding leakage of compressed gas through the gaps in the slide valve, and loss of energy due to occur during the passage of gas through pipelines.

It is advantageous to utilize used compressed gas to ensure a faster return of the ram and its reliable fixing in a collet. To this end, a non-return valve, intended for admitting the used gas to the closed chamber, is preferably built in the wall of the cylinder at a distance from the end thereof facing the die, approximately equal to the height of the ram.

It is also preferred to have the closed chamber arranged concentrically with the cylinder at the end thereof facing the die, and to have this chamber connected through ducts with the below-the-ram chamber of the cylinder. This will reduce both the travelling path and leakage of air on its way from the below-the-ram chamber to the closed chamber during the operating and return strokes of the ram.

To render the ducts more simple in construction and shorter in length, the valve can be accommodated in the opening, provided for this purpose in the cover, so as to communicate the above-the-ram-chamber with the atmosphere. The construction is simplified by means of the cover used as the body for both the valve and ducts formed therein, which makes unnecessary the use of pipelines.

To ensure a reliable return of the ram, it is advantageous to provide a non-return valve through which compressed gas is admitted under the ram and into a chamber which is to be filled with a fluid in the event of using it as the working medium while working pieces which require substantial amount of reduction.

The invention will now be described, by way of example only, with reference to the accompanying drawings, in which.

Figure 1:
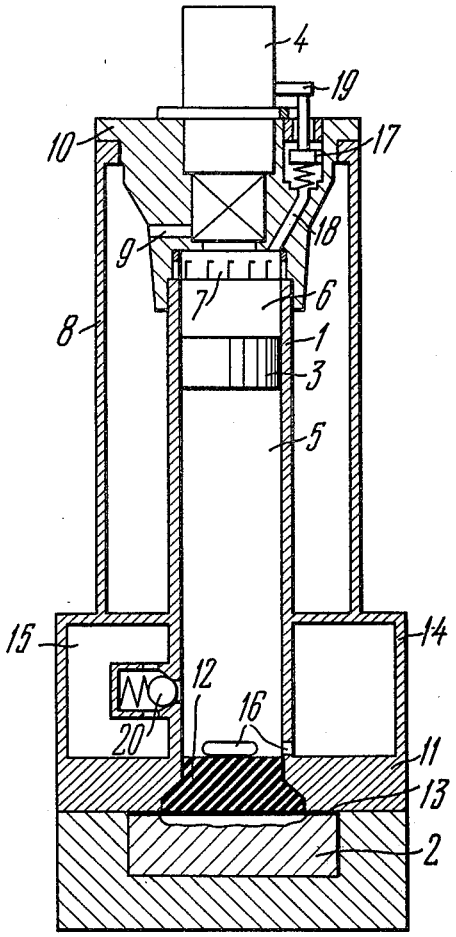
FIG. 1 is a longitudinal sectional view of a hydropunch for use in a press, according to the invention.

The hydropunch, illustrated, is a part of a hydraulic press.

The hydropunch comprises a cylinder 1, one end of which faces a die 2 of a hydraulic press. The cylinder 1 accommodates a ram 3 provided with an actuator 4 and a means enabling its return to original position. As the ram 3 is displaced, it forms a below-the-ram chamber 5 and an above-the-ram chamber 6. When in its upper position the ram 3 is retained in position by means of a collet 7, of known design which also functions as a shock-absorber, with the ram 3 returning to its original position (lifted) on completion of the operating stroke. Mounted on the upper end of the cylinder I, opposing the other end facing the die 2, is the ram actuator 4. The hydropunch also includes a compressed gas receiver 8 arranged concentrically with and surrounding the cylinder I. The receiver 8 communicates with the above-the-ram chamber of the cylinder I via a duct 9. There is also provided a cover 10 intended for closing both the cylinder I and receiver 8. The end of the cylinder I, facing the die 2, adjoins a high pressure chamber II filled with an elastic medium (fluid) 12, serving as the working body through which energy is transferred from the ram 3 to a workpiece 13 positioned on the die 2.

According to the invention, the means for returning the ram 3 to its original position comprises a closed chamber 14 arranged concentrically with the cylinder I at the end thereof facing the die 2. The chamber 14 has its interior 15 in communication with the below-the-ram chamber 6 of the cylinder I via ducts 16. The ram return means also has a valve 17 adapted to communicate the above-the-ram chamber 6 of the cylinder I with the atmosphere. The valve 17 is set in an opening, formed in the cover 10, and communicates with the above-the-ram chamber of the cylinder I via a duct 18. The valve 17 is opened by means of a lever 19 connected with a rod of a cylinder of the ram actuating means (not shown).

The means for returning the ram 3 to its original position incorporates a non-return valve 20 built in the wall of the cylinder 1 at a distance from the end thereof facing the die 2, approximately equal to the height of the ram 3. The non-return valve 20 is intended to admit the used gas into the closed chamber 14.

As an alternative to an elastic medium (rubber), use can be made of a hydro-elastic medium (fluid separated from the workpiece by an elastic diaphragm), or of a fluid filling the high-pressure chamber after the die with the workpiece are pressed against the above chamber.

Figure 2:
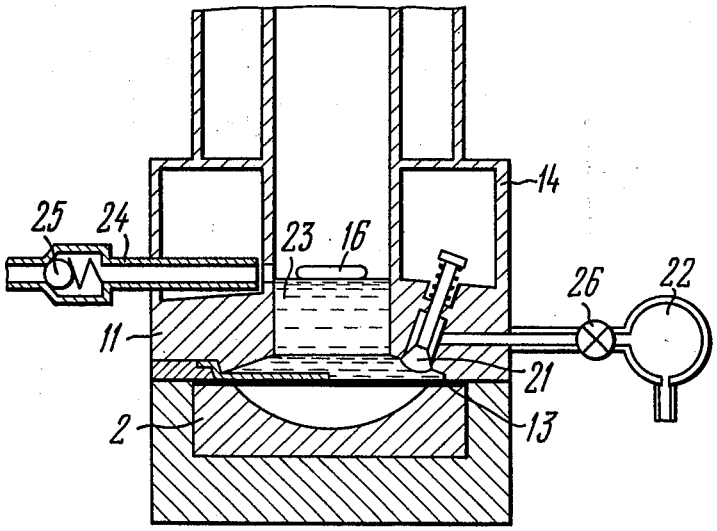
FIG. 2 is a partial longitudinal sectional view of same provided with a non-return-valve for admitting compressed gas therethrough into the chamber to be filled with a working fluid and FIG. 3 is a partial enlarged longitudinal sectional view of a portion of same.

In the event of using a fluid as the working body, use can be made of a non-return valve 21 (FIG. 2), set in the body of the chamber 11 and intended for admitting compressed gas from a receiver 22 under the ram 3 and into the chamber II which is filled with the fluid 23. The fluid is fed into the chamber II through a nozzle 24 connected to a fluid supply system, extending through the closed chamber 14 and provided with a non-return valve 25.

The hydropunch of the invention operates in the following manner.

Figure 3:
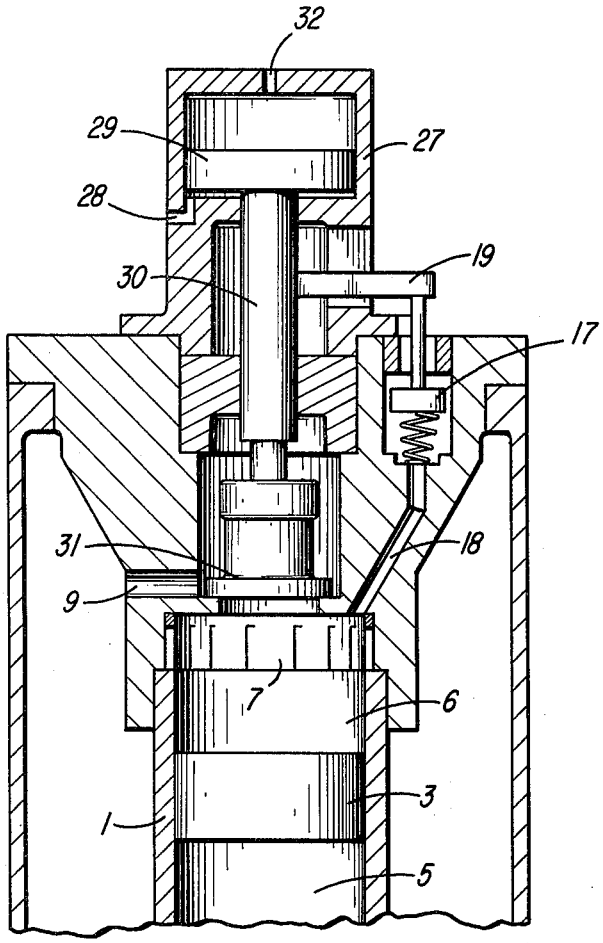

Shown in FIG. I is the final moment of returning of the ram 3 to its original position, with the duct 9 closed and the valve 17 open and compressed gas passes from the chamber 15, forcing the ram 3 to move upward. At the end of the upward stroke the ram 3 comes into engagement with the collet 7 and, having its kinetic energy damped, is held therewith. To initiate an operating stroke of the ram 3, the ram actuating means 4 open the duct 9 with the help of the rod of its cylinder 30. Specifically, for the ram 3 to perform a working stroke, the actuator 4 first disconnects the cylinder space above the ram from the atmosphere and then connects it with the duct 9 in the following manner: the rod chamber of the cylinder 27 (ref. FIG. 3) is supplied through a duct 28 with a compressed fluid, as a result of which the piston 29 moves the rod 30 with the lever 19 upwards, releasing the valve 17, and the space 6 above the ram in the cylinder 1 is cut off from the atmosphere. As the rod 30 moves further, it raises the valve 31, admitting gas from the receiver 8, through the duct 9, into the space 6 above the ram of the cylinder 1, so the ram 3 is accelerated. In the course of the downward movement of the ram 3, the air in the below-the-ram chamber 5 of the cylinder I is being forced out and through the ducts 16 is admitted into the interior 15 of the closed chamber 14. On reaching its extreme downward position, the ram 3 imparts a blow against the elastic medium 12 thereby converting the energy, accumulated during its downward movement, into an impulsive pressure, thereby effecting the deformation of the workpiece on the die 2.

When the ram 3 reaches its lowest position, the compressed gas effecting the downward movement of the ram 3 is admitted through the non-return valve 20 into the interior 15 of the chamber 14.

The ram actuating means 4 having a portion of the compressed gas that was admitted into the above-the-ram chamber 6 supplied into the piston space of cylinder 27 along duct 32, closes, in the first place, the duct 9, thereafter makes the valve 17 opened through pressing thereon by the lever 19 which is moved downward by rod 30 thus communicating the above-the-ram chamber 6 of the cylinder I via the duct 18 with the atmosphere. On having given up its energy for effecting deformation of the workpiece, the ram is forced upward by the compressed gas from the chamber 15 until it comes into engagement with the collet 7. Thus, the operating cycle is completed and the hydropunch is set for next cycle.

Another embodiment of the hydropunch according to the invention for effecting a similar operation wherein a fluid is used as an alternative working medium operates in the following manner.

The workpiece 13 is fixed in position on the die 2 and both are pressed against the high pressure chamber II, whereupon the fluid 23 through non-return valve 25 is fed thereinto via the nozzle 24 in the amount sufficient to fill in the interior of the chamber II. On gaining momentum after being actuated the ram imparts a blow against the fluid 23 which results in the deformation of the workpiece and in further lowering of the ram below the level of the ducts 16 to a depth, determined by the amount of the workpiece deformation. In order to lift the ram 3, compressed gas is fed from the interior of the receiver 22 and is admitted through the valve 26 to the chamber 11 filled by liquid in an amount not exceeding that of gas required for lifting the ram 3 to a height at which the lower end of the ram 3 is higher and above the lower edge of the ducts 16 (the volume of the receiver is determined in accordance with this requirement). Further upward movement of the ram 3 to its original position, until its engagement with the collet 7, is carried out under the effect of compressed gas available in the interior 15 of the closed chamber 14.

Such construction of the hydropunch for operating with a fluid employed as a working medium ensures a reliable return of the ram to its original position even in those instances wherein large amounts of reduction are involved.

What is claimed is:

1. A hydropunch for use in a press including a die having a working surface for receiving a piece to be worked, comprising: a cylinder having a wall body with two ends, a first end facing the working surface of the die, and a second end facing in the opposite direction from said first end; a ram accommodated within said cylinder for movement therealong so as to form therein an above the-ram chamber and a below-the-ram chamber; means for actuating said ram, said means being arranged on the second end of said cylinder; a compressed gas receiver selectively communicable with the above-the-ram chamber of said cylinder, said means for actuating controlling fluid communication between said compressed gas receiver and said above-the-ram chamber in such manner that said ram is moved from an original raised position towards the first end of said cylinder when fluid communication is established; a cover for closing both said cylinder and receiver; and means for returning the ram to said original position, said means including a closed chamber communicating with the below-the-ram chamber of said cylinder, a valve adapted to communicate the above-the-ram chamber of said cylinder with the atmosphere, said valve being built in an opening provided in said cover, and a non-return valve for admitting used gas into said closed chamber, said non-return valve being built in a wall of said cylinder at a distance, from the one end thereof facing the die, approximately equal to the height of the ram so that said above-the-ram chamber is in fluid communication with said closed chamber through said non-return valve when said ram is in the lowest position thereof, and a high pressure chamber containing an elastic fluid positioned at the end of cylinder between the ram and the working surface of the die.

2. A hydropunch as claimed in claim 1, wherein the closed chamber is arranged concentrically with the cylinder at the end thereof facing the die, said cylinder having its walls formed with ducts communicating the below-the-ram chamber thereof with said closed chamber.

3. A hydropunch for use in a press including a die having a working surface for receiving a piece to be worked, comprising: a cylinder having a wall body with two ends, a first of the ends facing the working surface of the die, and a second of the ends facing in the opposite direction from said first end; a ram accommodated within said cylinder for movement therealong so as to form therein an above-the-ram chamber and a below-the-ram chamber; means for actuating said ram, said means being arranged on the second end of said cylinder; a compressed gas receiver selectively communicable with the above-the-ram chamber of said cylinder, said means for actuating controlling fluid communication between said compressed gas receiver and said above-the-ram chamber in such manner that said ram is moved from an original raised position towards the first end of said cylinder when fluid communication is established; a cover for closing both said cylinder and receiver; means for returning the ram to said original position, said means including a closed chamber communicating with the below-the-ram chamber of said cylinder, and a valve adapted to communicate the above-the-ram chamber of said cylinder with the atmosphere, said valve being built in an opening provided in said cover;

a reservoir of fluid disposed in the bottom of said cylinder between said ram and the working surface of the die; and means operative when said ram is in the lowest position thereof for pressurizing said fluid so that said fluid exerts a force on said ram urging said ram towards its original position thereby raising said ram into a position located above the communication of the closed chamber with the below-the-ram chamber so that pressure accumulated in the closed chamber returns the ram to its original position.

* * * * *